US005695059A

United States Patent [19]

Reich

[11] Patent Number: 5,695,059

[45] Date of Patent: Dec. 9, 1997

[54] BOTTLE NECK HANGER AND DISPLAY

[75] Inventor: Kenneth Reich, Modesto, Calif.

[73] Assignee: E. & J. Gallo Winery, Modesto, Calif.

[21] Appl. No.: 789,561

[22] Filed: Jan. 28, 1997

[51] Int. Cl.[6] ..... B65D 75/00

[52] U.S. Cl. ..... 206/427; 206/776

[58] Field of Search ..... 206/769, 770, 206/771, 427, 429, 432, 459.5, 775, 776, 778, 779, 781, 782

[56] References Cited

U.S. PATENT DOCUMENTS

| | | | |
|---|---|---|---|
| 2,788,121 | 4/1957 | Ayres | 206/778 |
| 2,983,368 | 5/1961 | Vander Lugt, Jr. | 206/775 |
| 3,085,683 | 4/1963 | Harrison . | |
| 3,355,830 | 12/1967 | Hoffman . | |
| 3,408,758 | 11/1968 | Doring . | |
| 3,812,962 | 5/1974 | Cunningham . | |
| 4,722,733 | 2/1988 | Howson . | |
| 4,856,647 | 8/1989 | Dahne . | |
| 5,584,393 | 12/1996 | Korte | 206/779 X |

*Primary Examiner*—Jacob K. Ackun

*Attorney, Agent, or Firm*—Burns, Doane, Swecker & Mathis, L.L.P.

[57] ABSTRACT

A display device is disclosed which is in the form of a hanger formed from a single sheet of thermoplastic folded along the top of the hanger so that the two halves of the sheet of thermoplastic engage the top of the neck of a container at the center of the hanger. On one side of the container, the hanger is molded to receive a smaller container and on an opposite side of the hanger, a display is received in a flat area of the hanger. The hanger is secured in its folded condition at several areas which are joined together to secure the two halves of the hanger together.

16 Claims, 2 Drawing Sheets

BOTTLE NECK HANGER AND DISPLAY

FIELD OF THE INVENTION

The invention relates generally to a display device which can be attached to a container, and more particularly to a neck hanger for bottles.

BACKGROUND OF THE INVENTION

In marketing beverage products, such as wine, it is desirable to include a display card with the product when placed on the store shelf. The display card may include information about the beverage and the producer of the product. Such a display card should be arranged so that it cannot be dislodged or removed by shoppers.

If a producer desires to offer a premium or sample product with the main beverage product, it would be convenient for the store owner and the customer if the premium or sample product are closely associated with the main beverage product. Of course, it is also desirable to prevent theft or improper removal of the sample or premium.

U.S. Pat. No. 3,355,830 issued to Hoffman is an example of a prior attempt to associate an advertising display on the neck of a bottle. The display of the Hoffman patent, however, appears to be easily removable, and does not have any means for displaying a sample.

Various display devices are also known in the art which attach to objects and may include advertising material. For example, U.S. Pat. No. 3,408,758 issued to Doring discloses a display card for flashlights in which the display card is formed of plastic and has a plug which is provided with ribs which secure the light end of a flashlight in the card. In the one version disclosed by Doring, flashlight batteries are retained in cavities in the display card.

The known devices, however, do not provide a display device for the neck of a bottle that is suitable for secure attachment of the associated products and yet provides a readily visible advertising display.

OBJECTS AND SUMMARY OF THE INVENTION

It is therefore an object of the present invention to provide a display device that overcomes the deficiencies of prior display devices.

It is another object of the present invention to provide a display device which provides for the display of a premium or sample that is protected from theft or loss.

These and other objects are accomplished in accordance with this invention by a display device that is adapted to be secured on the neck of a bottle. The display device captures the enlarged end at the neck of the bottle and the device extends outwardly on opposite sides of the main bottle. On one side, the device has a means for holding an advertising sign or display. On the other side of the bottle, the device has a cavity that captures a sample container which is supported substantially parallel to the bottle. Preferably, the display device is formed of a thermoplastic material that is folded along an axis that is aligned with the top of the bottle and the sample container and the advertising display. The folded display device is secured together by a plurality of thermoplastic welds (RF seals).

DESCRIPTION OF THE DRAWING FIGURES

A preferred embodiment of the invention is described with reference to the accompanying drawings, wherein.

DESCRIPTION OF THE PREFERRED EMBODIMENTS

Figure 1:
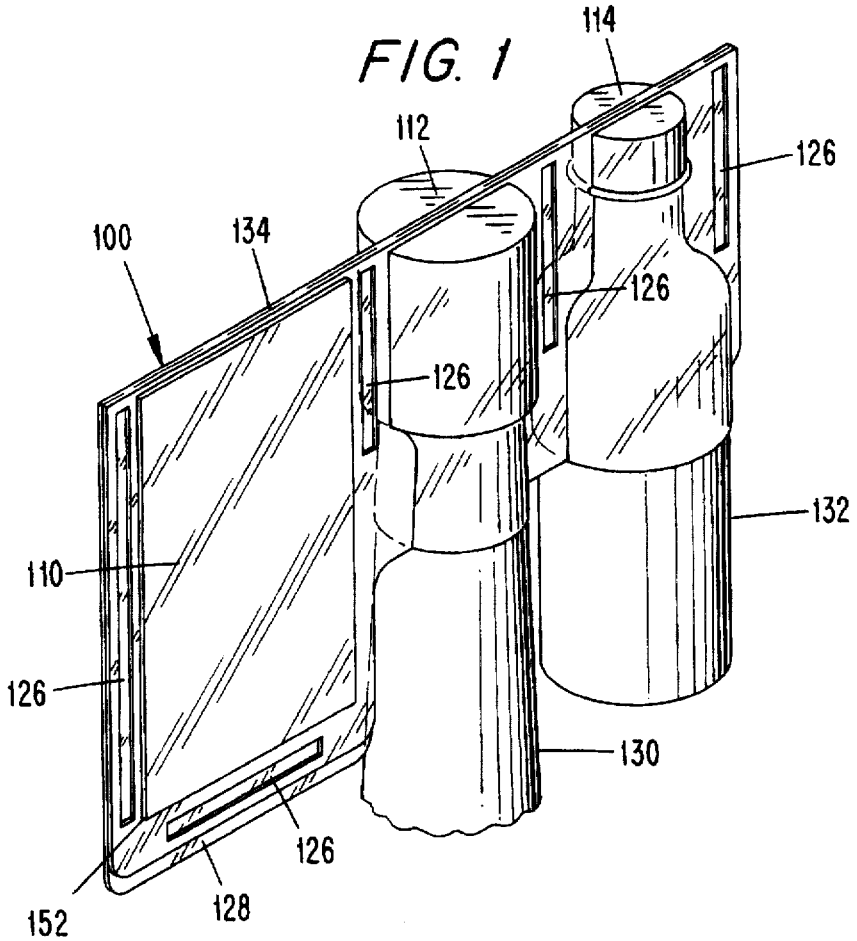
FIG. 1 is a perspective view of a display device in accordance with this invention.
Figure 2:
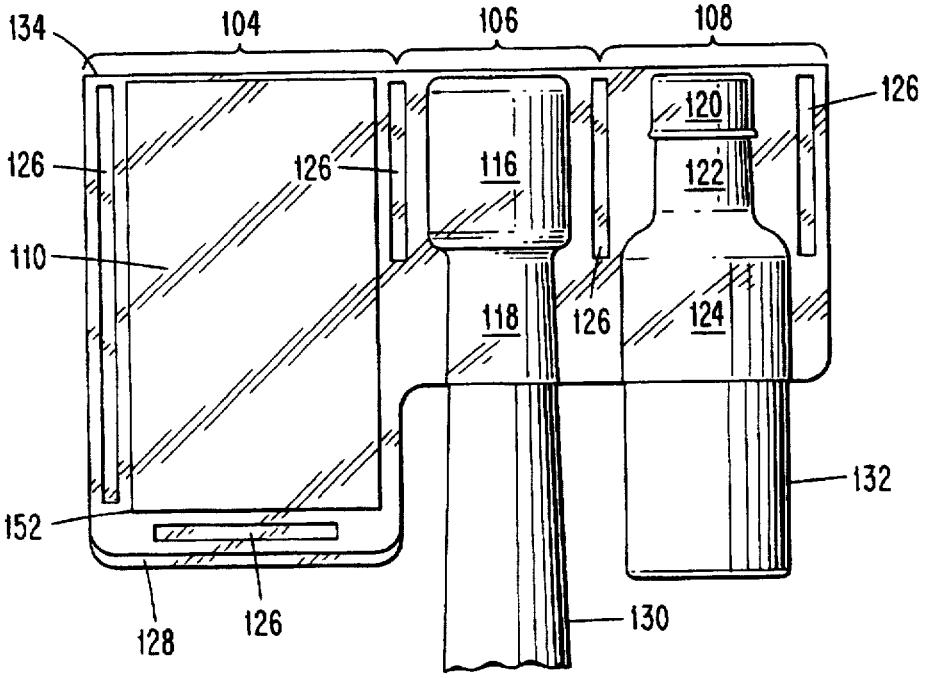
FIG. 2 is an elevational view of the display device of FIG. 1.

A display device 100 according to the present invention is shown in FIGS. 1 and 2. The display device 100 includes a display section 104, a main bottle section 106, and a sample section 108, as illustrated in FIG. 2. The display device 100 is preferably formed of a thermoplastic material. The main bottle section 106 includes a bottle neck top receiving portion 116, a bottle neck receiving portion 118, and a top portion 112. A wine or spirits bottle 130 typically has a flange around the mouth. The bottle top receiving portion 116 has a diameter and length that fits closely around the neck flange. The neck receiving portion 118 has a smaller diameter than the portion 116, so that the flange is captured in the device and cannot be separated from the device 100 without damaging the device. The sample section 108 includes a bottle top receiving portion 120, a bottle neck receiving portion 122, a container body receiving portion 124, and a top portion 114. The top receiving portion 120 has a diameter and length that fits closely around the top of the bottle 132. The neck receiving portion 122 has a smaller diameter than the portion 120 so that the sample bottle top is captured in the device 100 and cannot be separated from the device 100 without damaging the device. The body receiving portion 124 has a larger diameter than that of the neck portion 122, corresponding to the shape of the bottle being used. If the bottle 132 is short, it may be contained entirely within the device 100. Preferably, the height of the main bottle 130 is greater than the height of the sample bottle, so that the sample bottle is suspended by the display 100.

The display device 100 includes five joining regions 126 where opposite sides of the display device are joined to each other. Preferably, these regions 126 are joined by heat sealing. Alternatively, these joining regions 126 may be adhesively joined, press fit, ultrasonically welded, or joined by other suitable means.

At the bottom of the display section 104, as illustrated in FIG. 2, the display device 100 includes an overlap area 128. The overlap area 128 enables the purchaser to disassemble the display device 100 by grasping the opposite sides of the display device and separating them from each other.

Figure 3:
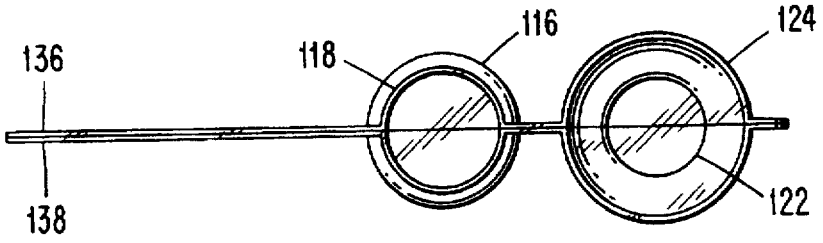
FIG. 3 is a bottom view of the display device of FIG. 1.
Figure 4:
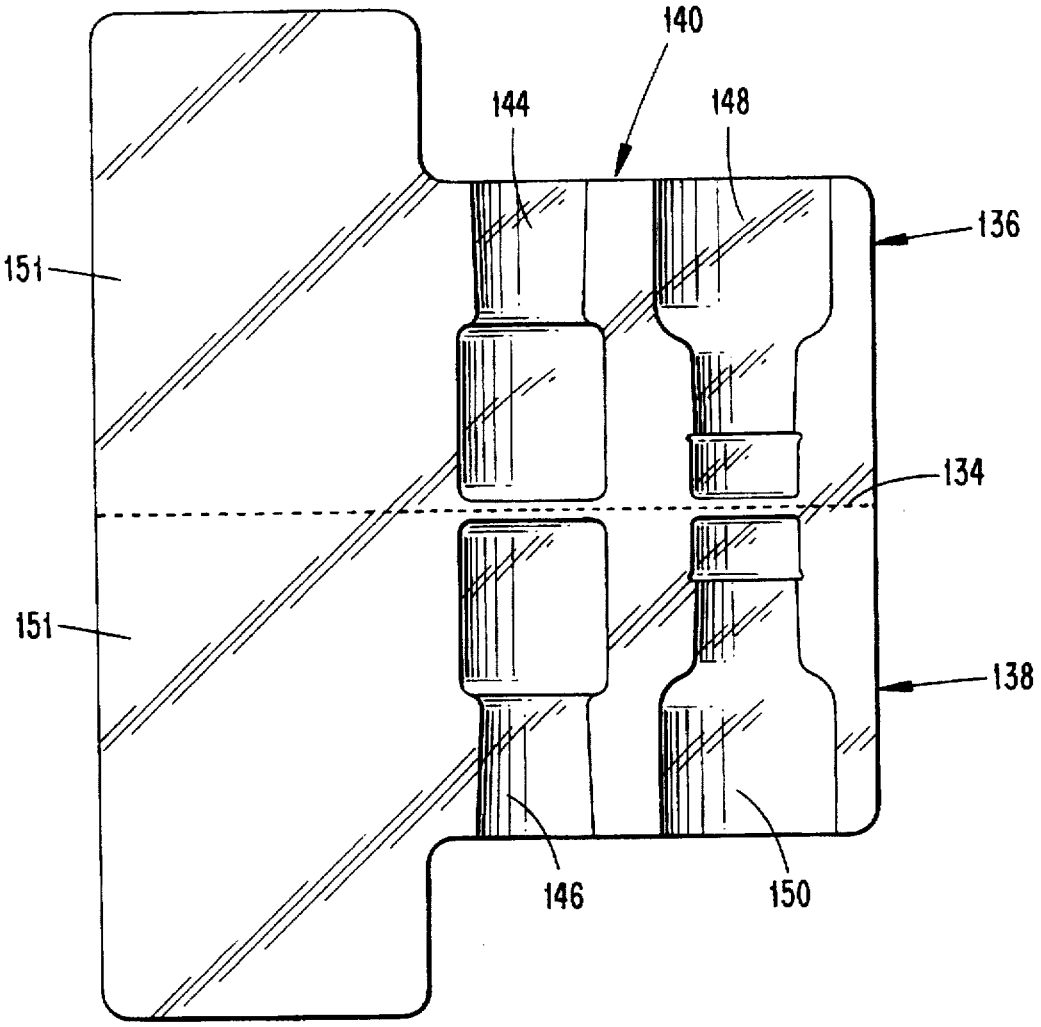
FIG. 4 is a top view of a blank used to form the display device of FIG. 1.

As illustrated in FIGS. 3 and 4, the display device 100 includes a first side 136 and a second side 138 which are secured together at joining regions 126 to form the display device 100. The first and second sides 136, 138 are substantially mirror images of one another.

The display device 100 is formed from a blank 140, as shown in FIG. 4. The blank 140 includes a first side 136 and a second side 138 separated by a fold line 134 which defines where the blank is folded. The blank 140 is preferably preformed to include two cavities 144, 146 for receiving the main bottle 130 and two cavities 148, 150 for receiving the sample bottle 132. The cavities 144, 146, 148, 150 are preferably preformed to conform to the size and shape of the bottles with which the display device 100 is to be used. Cavities 144, 146 define the main bottle neck top receiving portion 116 and the bottle neck receiving portion 118, as shown in FIG. 2. Cavities 148, 150 define the top receiving portion 120, the neck receiving portion 122, and the body receiving portion 124 as illustrated in FIG. 2. The display area 110 (FIG. 1) corresponds to the areas 151 of the blank 140.

As shown in FIGS. 1 and 2, the blank 140 is folded along the fold line 134 and pressed around the main bottle 130 and the sample bottle 132. A preprinted card or insert 152, as illustrated in FIGS. 1 and 2, may be placed between the areas 151 when the blank 140 is folded together. This preprinted card can be inserted after sealing through a slot in the display device 100. As the blank 140 has been preformed in the shape of portions of the bottles around which the blank 140 is to be pressed, the display device 100 is firmly secured to the main bottle 130 and the sample 132. After the blank has been folded at the fold line 142 to form the hinge 134, the regions 126 are then joined together to secure the first side 136 to the second side 138. The completed display device 100 is thereby firmly attached to the main bottle 130 and the sample bottle 132, and displays the information on the preprinted insert 152 in the display area 110. The joining regions 126 ensure that the first side 136 and the second side 138 do not become separated.

As an example of the advantages of the present invention, the main bottle 130 may be a wine bottle, the sample bottle 132 is a sample size bottle, such as a wine bottle, brandy bottle, or the like, and the information displayed in the display area 110 is a preprinted advertisement insert, coupon, or other preprinted material. The wine bottle 130 is preferably taller than the sample bottle 132, so that the sample bottle is suspended by the device 100. An advantage of the size differential and position of the sample bottle and card is that no extra space in the shipping carton or on the shelf is used. This arrangement occupies space that is otherwise unoccupied.

Although the embodiment illustrated in FIGS. 1 to 4 shows a rectangular information display area 110, the information display area may be any shape. For example, the information display area 110 may be circular, oval, square, triangular, or other suitable shape.

While the invention has been described in detail with reference to the preferred embodiments thereof, it will be apparent to one of ordinary skill in the art that various changes can be made, and equivalents employed, without departing from the spirit and scope of the invention.

What is claimed is:

1. A display hanger in combination with a bottle having a neck top flange and a neck portion, and with a second container the display hanger comprising:

a first cavity for receiving the neck top flange and neck portion of the bottle, the neck top flange of the bottle having a larger diameter than the neck portion;

a second cavity for receiving said second container, the second container cavity having a top receiving portion and a neck receiving portion, the top receiving portion having a larger diameter than the neck receiving portion; and a display portion for displaying information;

said bottle having a height greater than the second container.

2. The display hanger according to claim 1, wherein said first cavity and said second cavity and said display portion are aligned along an axis, the first cavity being located between the second cavity and the display portion.

3. The display hanger according to claim 1, wherein said display hanger is formed of a thermoplastic material.

4. The display hanger according to claim 1, wherein said display hanger is securely attached to the neck top flange.

5. The display hanger according to claim 1, wherein said display hanger is formed of two sides joined together.

6. The display hanger according to claim 5, wherein said display hanger further comprises a fold line, and said two sides are joined together.

7. The display hanger according to claim 6, including a plurality of joining areas, said joining areas being in the form of bars, the bars being arranged in parallel.

8. The display hanger according to claim 1, wherein said first receiving portion is substantially between said display portion and said second receiving portion.

9. A display device for a bottle and incorporating an advertising display and a sample container, comprising:

a sheet of material having a first cavity and a second cavity and a display area, the first cavity being between the second cavity and the display area;

means for capturing a bottle in the first cavity;

means for capturing a sample container in the second cavity;

said sheet being folded about a fold line extending along the first cavity and the second cavity; and means for joining the folded sheet together.

10. The display device according to claim 9, wherein the sheet is formed of a thermoplastic material.

11. The display device according to claim 9, wherein the means for capturing a bottle in the first cavity includes a cavity portion corresponding to the size of the neck flange of the bottle and a cavity portion corresponding to the size of the neck, the neck cavity portion having a smaller diameter than the neck flange cavity portion.

12. The display device according to claim 9, wherein the means for capturing a sample container in the second cavity includes a cavity portion corresponding to the size of the neck flange of the sample container and a cavity portion corresponding to the size of the neck, the neck cavity portion having a smaller diameter than the neck flange cavity portion.

13. The display device according to claim 9 including means for displaying advertising information between portions of the folded sheet.

14. A blank for forming a display hanger comprising:

a first side member and a second side member separated by a fold line;

said first side member including a first preformed cavity for receiving a portion of a first container;

a second preformed cavity for receiving a portion of a second container; and a display area for receiving advertising information to be displayed; said first preformed cavity being substantially between said display area and said second preformed area; and said second side member including a first preformed cavity for receiving a portion of the first container; a second preformed cavity for receiving a portion of the second container; and a display area for receiving advertising information to be displayed; said first preformed cavity being substantially between said display area and said second preformed cavity;

whereby, upon folding the blank over a bottle conforming to the first cavity and over a sample bottle conforming to the second cavity, the bottle and sample bottle are captured.

15. The blank according to claim 14, wherein the blank is formed of a thermoplastic material.

16. The blank according to claim 14, wherein the first side member and the second side member are substantially flat.

* * * * *